US005651483A

United States Patent [19]

Bell et al.

[11] Patent Number: 5,651,483

[45] Date of Patent: Jul. 29, 1997

[54] APPARATUS AND METHOD OF DELIVERING HOSIERY BLANKS OR PANTYHOSE IN PROPER ORIENTATION FOR FURTHER PROCESSING

[75] Inventors: Cecil Roland Bell, Pinnacle; Charles Richard Moyer, Charlotte, both of N.C.

[73] Assignee: Monarch Knitting Machinery Corporation, Glendale, N.Y.

[21] Appl. No.: 653,002

[22] Filed: May 24, 1996

[51] Int. Cl.[6] ..... A47G 25/90; B65G 53/24

[52] U.S. Cl. ..... 223/112; 406/151

[58] Field of Search ..... 223/111, 112, 223/75, 1, 77; 406/151, 152, 153

[56] References Cited

U.S. PATENT DOCUMENTS

| | | | |
|---|---|---|---|
| 3,520,262 | 7/1970 | Bolles et al. . | |
| 3,704,565 | 12/1972 | Glaze, Jr. | 223/112 |
| 3,806,009 | 4/1974 | Glaze, Jr. . | |
| 4,487,546 | 12/1984 | Cassinelli . | |
| 4,550,868 | 11/1985 | Hodges et al. | 223/43 |
| 4,613,065 | 9/1986 | Glaze, Jr. et al. . | |
| 4,620,494 | 11/1986 | Takatori et al. . | |
| 4,703,877 | 11/1987 | Kuniki et al. . | |
| 4,784,070 | 11/1988 | Thurner et al. | 223/112 |
| 4,919,315 | 4/1990 | Nakano | 223/76 |
| 5,094,371 | 3/1992 | Takamura et al. . | |
| 5,165,355 | 11/1992 | Fournier et al. . | |
| 5,261,579 | 11/1993 | Propach et al. . | |
| 5,373,977 | 12/1994 | Migliosini | 223/112 |
| 5,456,392 | 10/1995 | Majors | 223/112 |
| 5,497,235 | 3/1996 | Bell . | |

*Primary Examiner*—Bibhu Mohanty

*Attorney, Agent, or Firm*—Bell, Seltzer, Park & Gibson, P.A.

[57] ABSTRACT

A method and apparatus for delivering elongate flexible objects, such as hosiery blanks or pantyhose, in proper orientation for further processing including removing one or more flexible objects from a bundle and presenting a selected end thereof, to ensure proper orientation, to an entry end of a suction tube, transporting the flexible object through the suction tube to an exit and thereof, preparing the leading end thereof for transfer and transferring the leading end of the flexible object onto an object receiving member of a further processing machine.

31 Claims, 6 Drawing Sheets

APPARATUS AND METHOD OF DELIVERING HOSIERY BLANKS OR PANTYHOSE IN PROPER ORIENTATION FOR FURTHER PROCESSING

FIELD OF THE INVENTION

This invention relates to the manufacture of elongate flexible objects, such as hosiery products, and more particularly to the manufacture of pantyhose from hosiery blanks.

BACKGROUND OF THE INVENTION

Hosiery products are customarily manufactured by knitting elongate, tubular blanks on circular knitting machines. Such blanks have welt portions at one end and toe portions at the other end thereof. These blanks are subsequently processed into hosiery products which may include socks, knee-high stockings, thigh-high stockings and pantyhose.

With all of these hosiery products, the blanks are typically delivered from the knitting machine with open toe portions which must be closed by seaming on sewing machines. Such toe portions are normally closed by skilled operators manually operating sewing machines or more automated toe closing machines. In both cases, it is important that the hosiery blanks be delivered to the toe closing operation in the proper orientation for that processing operation to occur with minimum handling of the hosiery blanks.

In the manufacture of pantyhose, hosiery blanks from the knitting machine are processed prior to formation thereof into pantyhose. One such processing step usually performed is autoclaving, in which a large amount of hosiery blanks are placed in an autoclave and subjected to heat (in the form of steam) under pressure to shrink the hosiery blanks and prepare them for formation into pantyhose. Normally, the hosiery blanks are washed and dyed before formation into pantyhose, while sometimes the hosiery blanks are first formed into pantyhose before washing and dyeing.

Customarily, a pair of hosiery blanks are formed into a pantyhose by having the welt portions thereof slit for a predetermined distance and the slit edges sewn together, with or without a crotch piece being inserted. Several types of semi-automated machines have been developed and are currently available commercially for performing the welt portion slitting and seaming. These machines are referred to in the trade as "line closers" and Takatori Machinery Mfg. Co., Ltd. supplies several different models of such line closers.

Such line closers include respective pairs of welt portion receiving members over which the opened welt portions of the hosiery blanks are positioned in surrounding relation. Initially, these welt portions were opened and positioned manually over the receiving members. This manual operation required skilled operators who must quickly and accurately pick-up, orient and place a pair of hosiery blanks in position. Also, such manual operations were expensive and fraught with labor problems.

Many attempts have been made to deliver oriented pantyhose blanks to such a line closer. Examples of such mechanisms are disclosed in U.S. Pat. No. 4,620,494, issued Nov. 4, 1986 to Takatori Corporation; U.S. Pat. No. 5,511,501, issued Apr. 30, 1996 to the assignee of this application. While substantially fully automated and capable of delivering properly oriented hosiery blanks onto the receiving members of a line closer, these prior mechanisms are exceedingly complex and therefore expensive. In addition, maintenance of such complex mechanisms is anticipated to be both difficult and time consuming. It is believed, therefore, that a need exists for a simple, reliable and inexpensive mechanism for delivering hosiery blanks or other flexible objects for further processing, such as to a line closer.

Once the hosiery blanks are slit and sewn together to form the panty portion of the pantyhose and the toe portions have been closed, it is necessary, in most instances, to inspect the completed pantyhose prior to packaging. Typically a pair of pantyhose is positioned on inspection forms by a skilled operator who inspects the pantyhose for defects. This manual inspection is time consuming, expensive and labor intensive.

Recently, it has been proposed to inspect pantyhose by mechanized inspection apparatus. One example of such an inspection apparatus is disclosed in U.S. Pat. No. 5,497,235, issued Mar. 5, 1996 to the assignee of this application. While the inspection of the pantyhose is mechanized in this apparatus, the positioning of the pantyhose on the inspection forms is performed manually. Such manual positioning of the pantyhose requires considerable skill and is expensive.

It is typical for first quality pantyhose to be delivered from the inspection apparatus to a boarding machine, such as an Auto Setter, manufactured by Takatori Corporation. U.S. Pat. No. 4,703,877, issued Nov. 3, 1987 and U.S. Pat. No. 5,094,317, issued Mar. 10, 1992 to Takatori Corporation disclosed pantyhose boarding apparatus, with U.S. Pat. No. 4,703,877 disclosing a transfer mechanism for transferring the pantyhose from the inspection forms to the boarding forms.

There are instances in which it may be desirable to mount the pantyhose directly on the boarding forms of a boarding apparatus without first positioning the pantyhose on an inspection apparatus. In the past, such mounting of pantyhose on boarding forms was performed manually by placing the pantyhose directly onto the boarding forms or by manually placing the pantyhose on a transfer device that then positioned the pantyhose on the boarding forms.

SUMMARY OF THE INVENTION

With the foregoing in mind, it is an object of the present invention to provide a method and apparatus for delivering elongate flexible objects, such as hosiery blanks or pantyhose, in proper orientation for further processing in a simple, reliable and inexpensive manner.

This object of the present invention is accomplished by providing a work station including a support for one or more bundles of the flexible objects, a plurality of elongate suction tubes having entry ends at the work station for receipt of the flexible objects therein, exit ends at the other end of the suction tubes and a transfer mechanism for transferring the flexible objects in proper orientation to the further processing apparatus.

An operator, who may be relatively unskilled, removes a predetermined number of flexible objects from the bundle and presents one end thereof, corresponding to the end to be positioned foremost on the further processing machine, to the entry end of one or more of the suction tubes. The suction tube(s) receives and transports the flexible object(s) to the exit end thereof in proper orientation for further processing.

If the present invention is employed with a line closer in the formation of pantyhose, a plurality of pairs of the suction tubes are provided for simultaneously receiving and transporting respective pairs of hosiery blanks, welt end first to the exit ends thereof. At the exit ends of the suction tubes, the welt ends portions of the hosiery blanks are opened, preferably by being partially everted over the exit end portions of the suction tubes. The transfer mechanism picks up the opened welt end portions, withdraws the pair of hosiery blanks from the suction tubes and positions the welt end portions on the receiving members of the line closer.

If the present invention is employed with an inspection or boarding machine, a plurality of single suction tubes are provided to receive and transport, panty first, pantyhose to the exit ends thereof. The transfer mechanism removes the pantyhose from the exit ends of the suction tubes, delivers the pantyhose to the inspection or boarding apparatus and positions the pantyhose on the inspection or boarding forms.

BRIEF DESCRIPTION OF THE DRAWINGS

Some of the objects and advantages of the present invention having been stated, others will appear as the description proceeds when considered in conjunction with the accompanying schematic drawings, in which.

DETAILED DESCRIPTION OF THE ILLUSTRATED EMBODIMENTS

Figure 1:
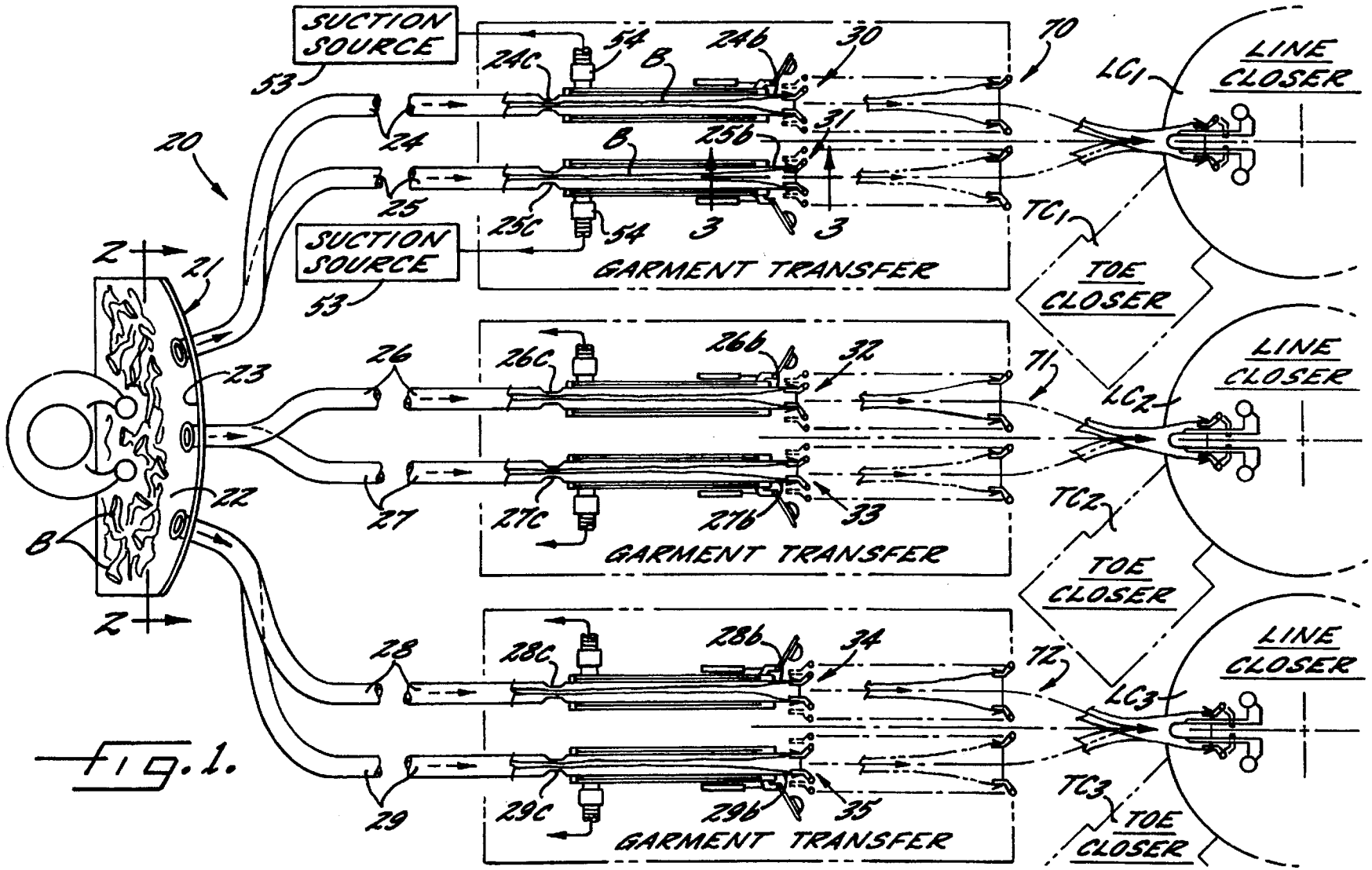
FIG. 1 is a schematic view of the apparatus of the present invention associated with a plurality of line closers.

Referring now more specifically to the drawings and particularly to FIG. 1, there is illustrated an apparatus, generally indicated at 20, incorporating the features of the present invention. Apparatus 20 is associated with a plurality of line closers $LC_1$, $LC_2$ and $LC_3$. The line closers $LC_1$, $LC_2$ and $LC_3$ may include or be associated with toe closers $TC_1$, $TC_2$ and $T_3$. U.S. Pat. Nos. 4,541,341 and 4,620,494 disclose line closers and toe closers of the type with which apparatus 20 may be associated, although the present invention should not be considered as being limited to these particular line and toe closers. The disclosures of U.S. Pat. Nos. 4,541,341 and 4,620,494 are incorporated herein by reference for a more complete understanding of the construction and operation of these typical line and toe closers.

Apparatus 20 includes a work station, generally indicated at 21, which includes a table 22 for supporting elongate flexible objects, such as hosiery blanks B thereon. Work station 21 also includes a vertical member or console 23 extending upwardly from the rear portion of table 22. Preferably, vertical member 23 is concave with respect to the front of the table 22.

Figure 2:
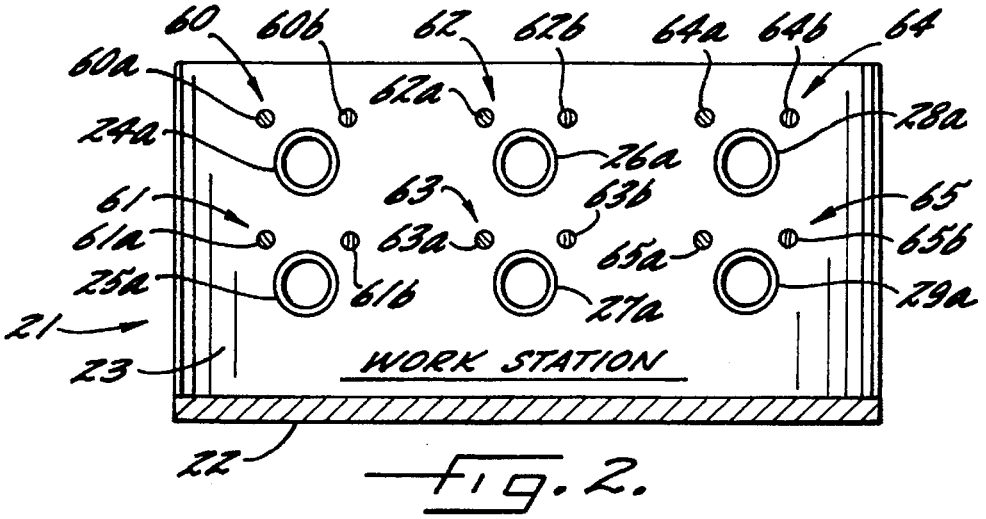
FIG. 2 is a vertical sectional view of the work station taken substantially along line 2—2 in FIG. 1.

A plurality of pairs of suction tubes 24, 25; 26, 27 and 28, 29 have inlet ends 24*a*, 25*a*, 26*a*, 27*a* and 28*a*, 29*a* mounted on vertical member 23 of work station 21 (FIGS. 1 and 2). The inlet ends 24*a*, 25*a*; 26*a*, 27*a* and 28*a*, 29*a* of suction tubes 24, 25; 26, 27 and 28, 29 are readily available to an operator at the work station 21 for presentation of pairs of hosiery blanks B thereto.

The suction tubes of the respective pairs of suction tubes 24, 25; 26, 27 and 28, 29 extend in juxtaposed, parallel relation to exit ends 24*b*, 25*b*; 26*b*, 27*b* and 28*b*, 29*b* thereof. These exit ends 24*b*, 25*b*; 26*b*, 27*b* and 28*b*, 29*b* are disposed in association with, but spaced a predetermined distance from, the respective line closers $LC_1$, $LC_2$ and $LC_3$. The suction tubes 24, 25; 26, 27 and 28, 29 have restrictions 24*c*, 25*c*; 26*c*, 27*c* and 28*c*, 29*c* therein to straighten and center the blanks B to facilitate transfer thereof.

Figure 6:
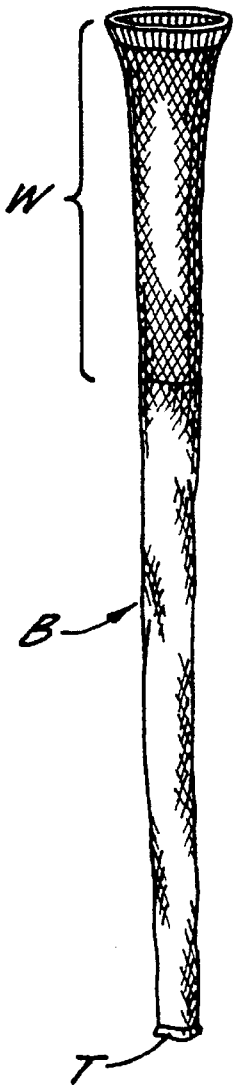
FIG. 6 is an elevational view of a typical hosiery blank.
Figure 7:
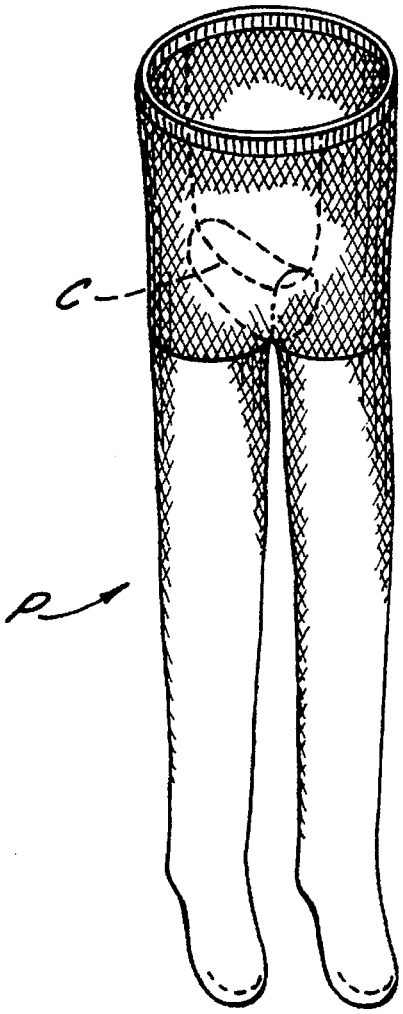
FIG. 7 is a front perspective view of a typical pair of pantyhose.

The hosiery blanks B include a welt portion W and a toe portion T (FIG. 6). The welt portion W is adapted to be slit longitudinally thereof and the slit edges of a pair of hosiery blanks B are sewn together to form the panty portion of a pantyhose P (FIG. 7). If desired, a crotch piece C may be sewn into the panty portion between the slit edges of the hosiery blanks B.

Figure 3:
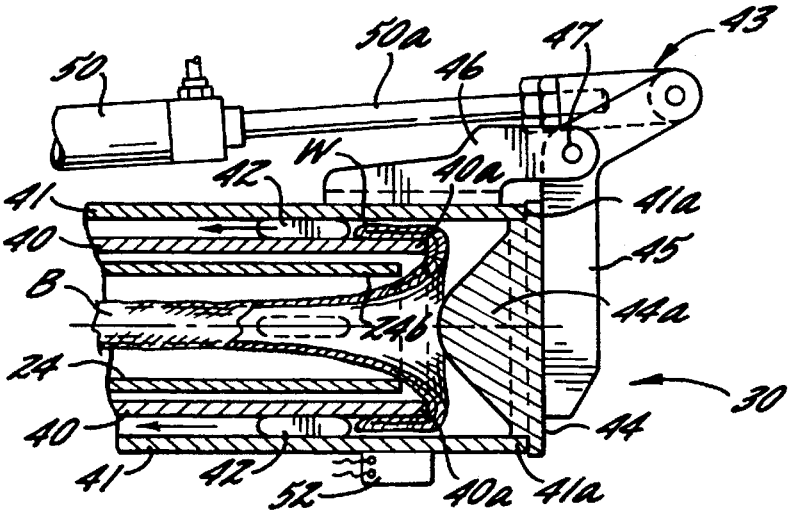
FIG. 3 is an enlarged, fragmentary sectional view taken substantially along line 3—3 in FIG. 1.
Figure 4:
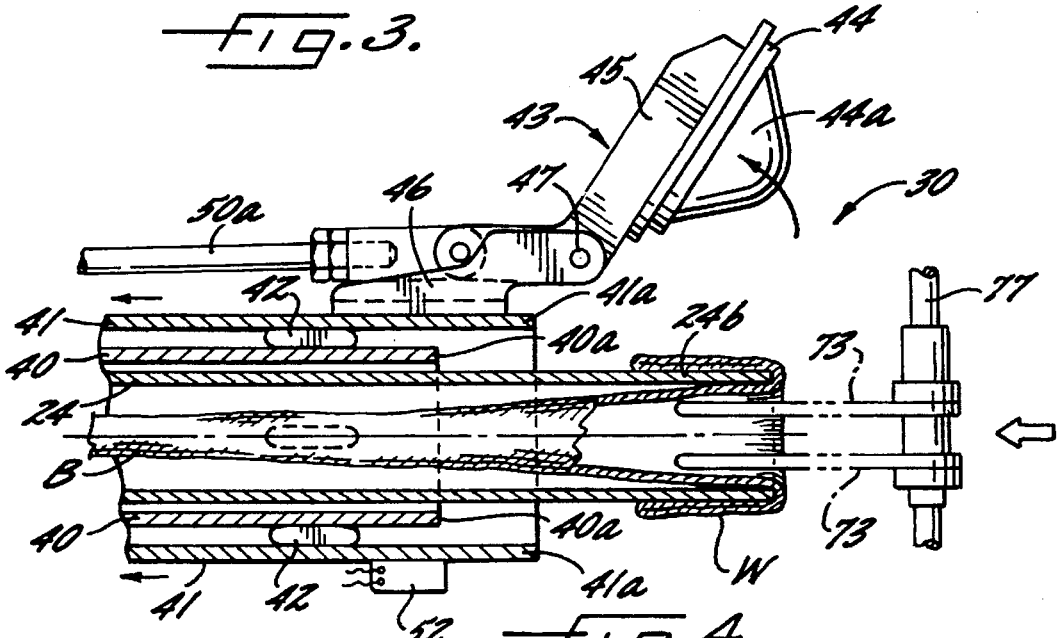
FIG. 4 is a view similar to FIG. 3 of an exit end portion of a suction tube, with the same shown in association with a transfer mechanism.

The hosiery blanks B are presented by the operator to the inlet ends 24*a*, 25*a*; 26*a*, 27*a* and 28*a*, 29*a* welt portion W first, such that the blanks B are transported by the suction tubes 24, 25; 26, 27 and 28, 29 in proper orientation for delivery to the line closers $LC_1$, $LC_2$ and $LC_3$. To prepare the hosiery blanks B for transfer to the line closers $LC_1$, $LC_2$ and $LC_3$, the welt portions W thereof must be opened. Preferably, the welt portions W are opened by being partially everted over the exit ends 24*b*, 25*b*; 26*b*, 27*b* and 28*b*, 29*b* of the suction tubes 24, 25; 26, 27 and 28, 29 (FIGS. 3 and 4).

The suction tubes 24, 25; 26, 27 and 28, 29 have welt portion opening means, generally indicated at 30, 31; 32, 33 and 34, 35 at the exit ends 24*b*, 25*b*; 26*b*, 27*b* and 28*b*, 29*b* thereof. These opening means 30, 31; 32, 33 and 34, 35 are identical and therefore only means 30 will be described in detail. Further, these opening means 30, 31; 32, 33 and 34, 35 are disclosed in co-pending application Ser. No. 08/295,984, filed Aug. 25, 1994, entitled "Method and Apparatus for Handling Flexible Objects" and assigned to the assignee of this application, the disclosure of which is incorporated herein by reference.

The welt opening means 30 includes an inner tube 40 surrounding the exit end portion 24*b* of the suction tube 24 and an outer tube 41 surrounding the inner tube 40 and spaced therefrom a predetermined distance by spacers 42. The outer tube 41 has its outer end 41*a* spaced outwardly beyond the outer end 40*a* of inner tube 40 and the spacers 42 are spaced inwardly from the outer end 40*a* of the inner tube 40 a predetermined distance corresponding to the amount of the welt portion W that is to be everted or turned back upon itself.

The outer end 41*a* of the outer tube 41 is selectively closed or opened by a closure means 43. Closure means 43 includes a cap member 44 having an L-shaped lever 45 on one leg of which the cap member is mounted. L-shaped lever 45 is pivotally mounted on a bracket 46, which in turn is mounted on outer tube 41, by a pivot pin 47 at the juncture of the legs of the lever 45. A double-acting cylinder 50 is mounted on outer tubes 41 and has a piston rod 50*a* thereof connected to the other leg of the lever 46 for operating the end cap member 44 between open and closed positions (FIGS. 3 and 4).

The inner tube 40 and outer tube 41 are slidably mounted on the exit end portion 24*b* of suction tube 24 for translational movement therealong between a normal, operative position (as shown in FIG. 3) and a retracted position (as shown in FIG. 4). Reciprocating means (not shown) is provided for reciprocating the tubes 40 and 41 such means being shown and described in U.S. Pat. No. 5,511,501, incorporated herein by reference.

Preferably, the end cap member 44 has a bulbous portion 44*a* on the inside surface thereof which is adapted to be contacted by the welt portion W to assist in opening and partially everting the same. Further, a sensing means 52 is mounted on outer tube 41 for sensing when the welt portion W is partially everted and initiating retraction of the tubes 40 and 41.

The space between the inner tube 40 and the outer tube 41 is connected to a suitable source of suction 53 by a flexible tube 54 (FIG. 1). With end cap member 44 in closed position, the suction applied to the space between the inner tube 40 and outer tube 41 is also applied to suction tube 24 to move the hosiery blank B from the entry end 24*a* of tube 24 to the exit end 24*b* thereof. The work station 21 includes indicating means 60, 61; 62, 63 and 64, 65 associated respectively with suction tubes 24, 25; 26, 27 and 28, 29 for indicating when the suction tubes are available to receive a hosiery blank B and when the suction tubes are unavailable because a hosiery blank B is therein or suction is not present. Preferably, the indicating means 60, 61; 62, 63 and 64, 65 are in the form of green lights 60*a*, 61*a*; 62*a*, 63*a* and 64*a*, 65*a* and red lights 60*b*, 61*b*; 62*b*, 63*b* and 64*b*, 65*b* (FIG. 2).

Transfer means 70, 71 and 72 are associated with the exit ends 24*b*, 25*b*; 26*b*, 27*b* and 28*b*, 29*b* of the suction tubes 24, 25; 26, 27 and 28, 29 and the line closers $LC_1$, $LC_2$ and $LC_3$ for transferring pairs of hosiery blanks B from the pairs of suction tubes 24, 25; 26, 27 and 28, 29 onto welt portion receiving members of the line closers $LC_1$, $LC_2$ and $LC_3$. Each of the transfer means 70, 71 and 72 are substantially identical and therefore only transfer means 70 will be described.

Figure 5:
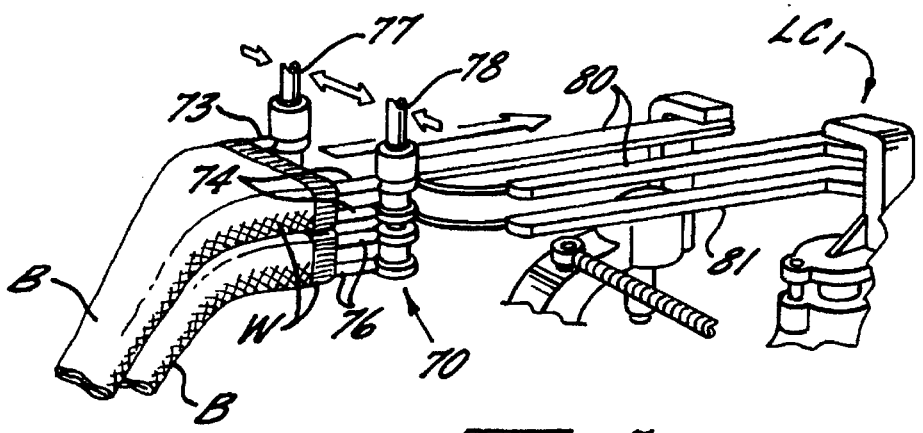
FIG. 5 is a fragmentary, somewhat schematic perspective view of a transfer mechanism transferring a pair of hosiery blanks onto a pair of welt portion receiving members of a line closer.

Transfer means 70 includes two sets of respective pairs of gripping fingers 73, 74 and 75, 76 (FIG. 5) which are cantileverly mounted on vertical shafts 77 and 78. The shafts 77 and 78 are mounted (in a manner not shown) for movement toward each other to collapse the pairs of gripping fingers 73, 74 and 75, 76 and away from each other to spread apart the pairs of gripping fingers 73, 74 and 75, 76 to grip and further open the welt portions W of the hosiery blanks B to be transferred. The shafts 77 and 78 are also mounted (in a manner not shown) for movement toward the exit ends 24*b*, 25*b* of suction tubes 24 and 25 to pick-up a pair of hosiery blanks B and away from the suction tubes 24, 25 and into operative association with welt receiving members 80 and 81 of line closer $LC_1$.

In accordance with the method of this invention and in operation of the apparatus 20, a bundle of hosiery blanks B is placed on table 22 of work station 21. The hosiery blanks B in the bundle may be randomly arranged within the bundle, but preferably have all of the welt portions at one end of the bundle and the toe portions at the other end thereof. Since hosiery blanks are delivered from knitting machines in the same orientation, such orientation can be preserved during processing between the knitting machine and the line closer without an excessive amount of difficulty.

An operator (who may be relatively unskilled and therefore less expensive than skilled operators) removes a pair of hosiery blanks B from the bundle simultaneously, looks at the indicating means 60–65 on the console 23 to locate an available pair of suction tubes, and then presents the individual welt portions W of the pair of hosiery blanks B to the entry ends 24*a*, 25*a*; 26*a*, 27*a* or 28*a*, 29*a* of a respective pair of the suction tubes. The suction tubes 24, 25; 26, 27 or 28, 29 suck the hosiery blanks B, welt portion first, thereinto and transport the same to the exit ends 24*b*, 25*b*; 26*b*, 27*b* or 28*b*, 29*b* thereof.

Upon arrival at the exit ends of the suction tubes, the welt portions W travel beyond the terminal ends of the suction tubes and engage the bulbous portion 44*a* of end cap member 44 which partially opens the welt portion of each blank. The suction causes the welt portions W to be partially everted over the outer ends of the suction tubes and the inner tubes 40 and into the spaces between the inner tubes 40 and outer tubes 41 until the welt portions W engage the spacers 42 which serve as a stop.

The sensor means 52 senses the everted welt portions W and actuates cylinder 50 to open end cap member 44 and the reciprocating means (not shown) for the inner tubes 40 and outer tubes 41 to retract the tubes. The transfer means 70, 71, or 72 is actuated to collapse the respective pairs of gripping fingers 73, 74 and 75, 76 and to insert the outer end portions thereof into the opened, partially everted welt portions W. Once inserted, the pairs of gripping fingers 73, 74 and 75, 76 are spread apart to engage the welt portions W and the inside of the exit ends of the suction tubes 24, 25; 26, 27 or 28, 29. The inner tubes 40 and outer tubes 41 are then extended by the reciprocating means (not shown) to unevert or unfold the partially everted welt portions W.

Immediately thereafter, the transfer means 70, 71 or 72 is retracted to remove the pairs of gripping finger 73, 74 and 75, 76 from the suction tubes. The pairs of gripping fingers 73, 74 and 75, 76 are further spread apart to open further the welt portions W to prepare the same for positioning on the welt receiving member 80 and 81 of the line closer $LC_1$, $LC_2$ or $LC_3$. Continued retraction of the transfer means 70, 71 or 72 withdraws the hosiery blanks B from the pair of suction tubes.

The respective pairs of gripping fingers 73, 74 and 75, 76 are spread apart a distance slightly greater than the width of the welt receiving members 80 and 81 so that the gripping fingers pass along opposite sides of these welt receiving members 80 and 81 until the welt portions W are properly located thereon. The pairs of gripping fingers 73, 74 and 75, 76 are then partially collapsed and removed from the welt portions to leave the welt portions W on the welt receiving members 80, 81 of the line closer. The transfer means 70, 71 or 72 then returns to its original starting position.

Once the pair of hosiery blanks W are fully withdrawn from the pair of suction tubes 24, 25; 26, 27 or 28, 29, the end cap member 44 is returned to its closed position as are the inner tubes 40 and outer tubes 41. Suction is once again applied to the pair of suction tubes 24, 25; 26, 27 or 28, 29 and the corresponding indicating means 60, 61; 62, 63 or 64, 65 will change from a red light to a green light and indicate to the operator that the pair of suction tubes is available to receive another pair of hosiery blanks B.

Figure 8:
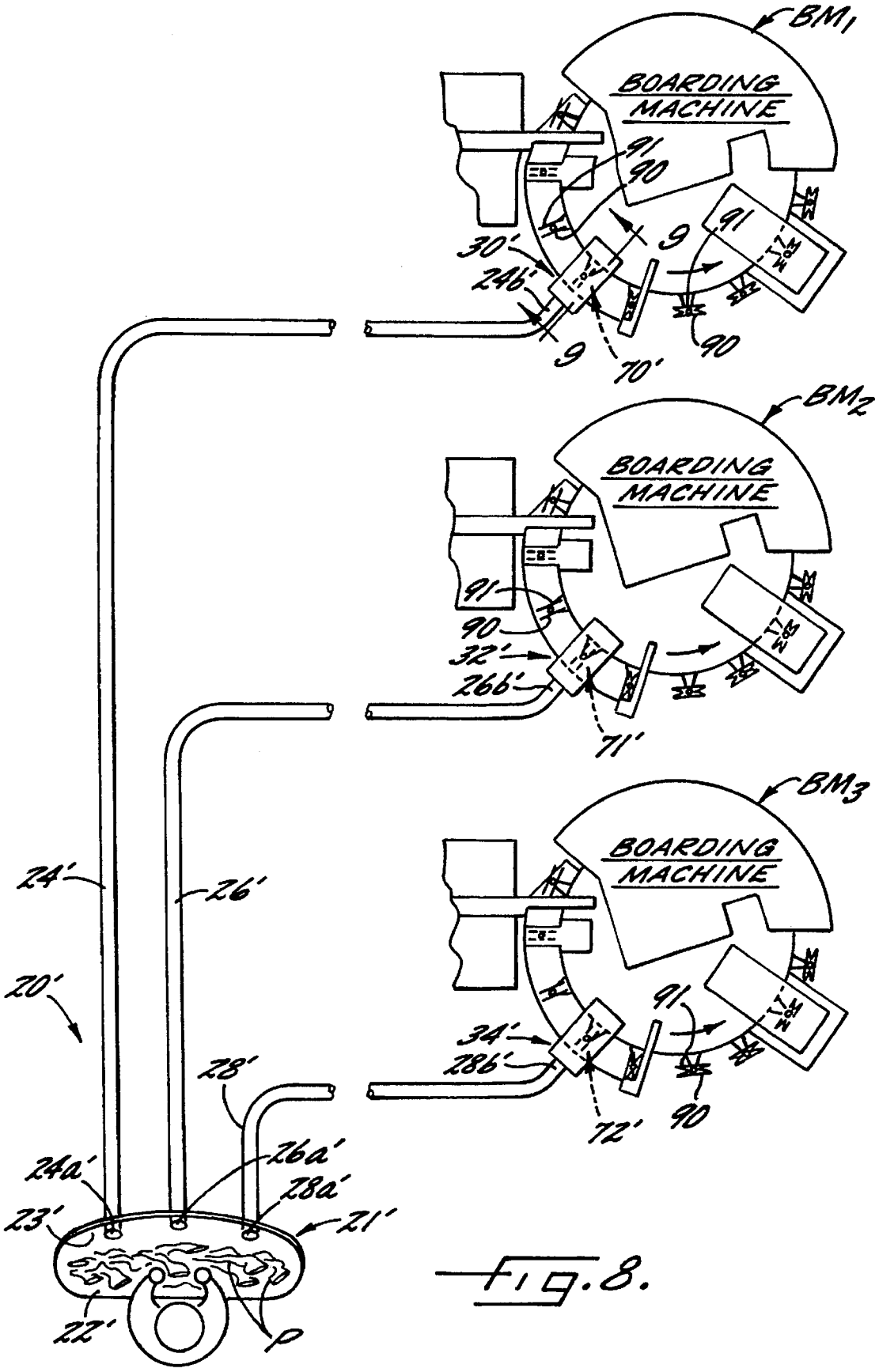
FIG. 8 is a schematic plan view of a still further embodiment of the present invention in which the apparatus of the present invention is associated with a plurality of boarding machines.
Figure 9:
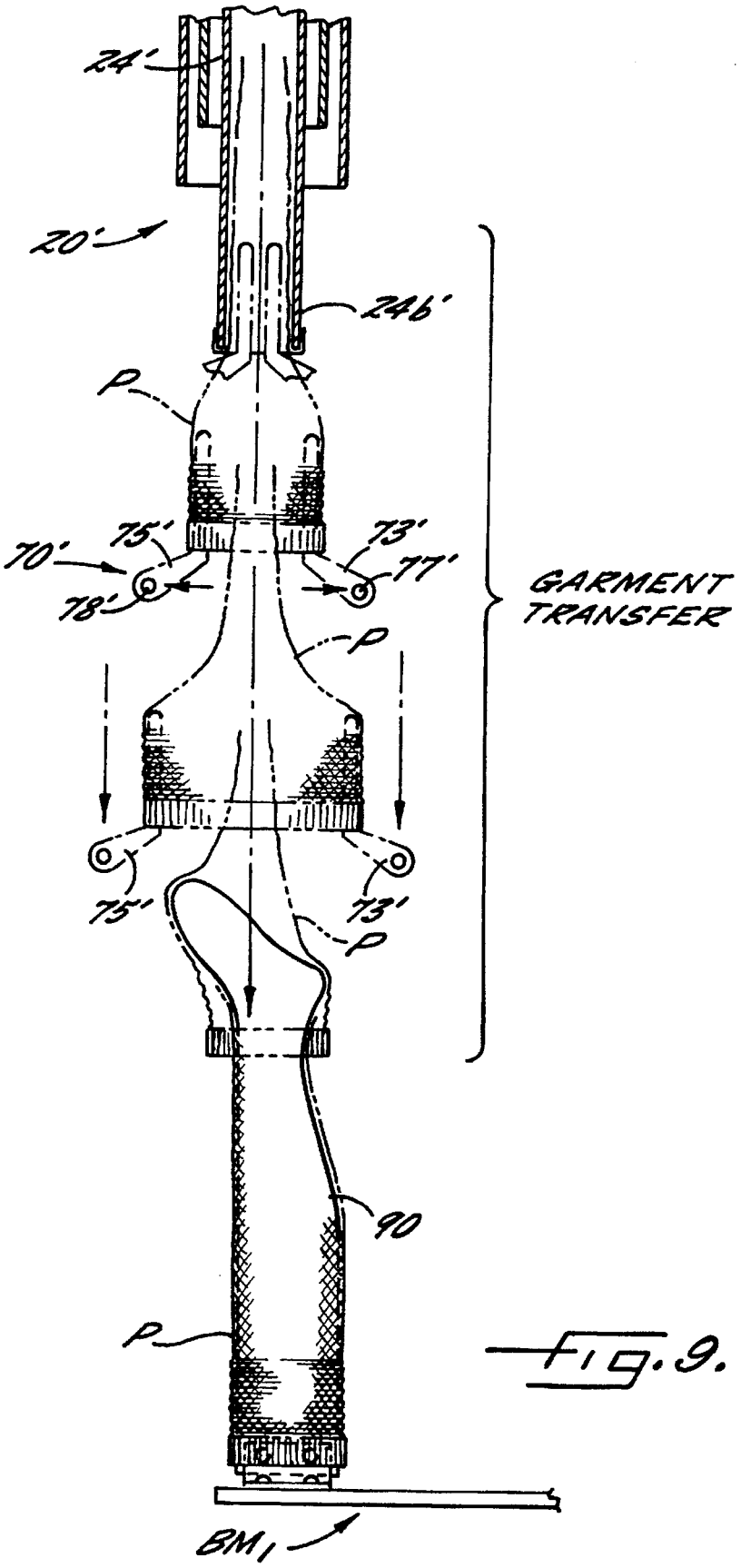
FIG. 9 is a somewhat schematic, fragmentary elevational view, partially in section, illustrating the transfer of a pair of pantyhose onto a pair of boarding forms.
Figure 10:
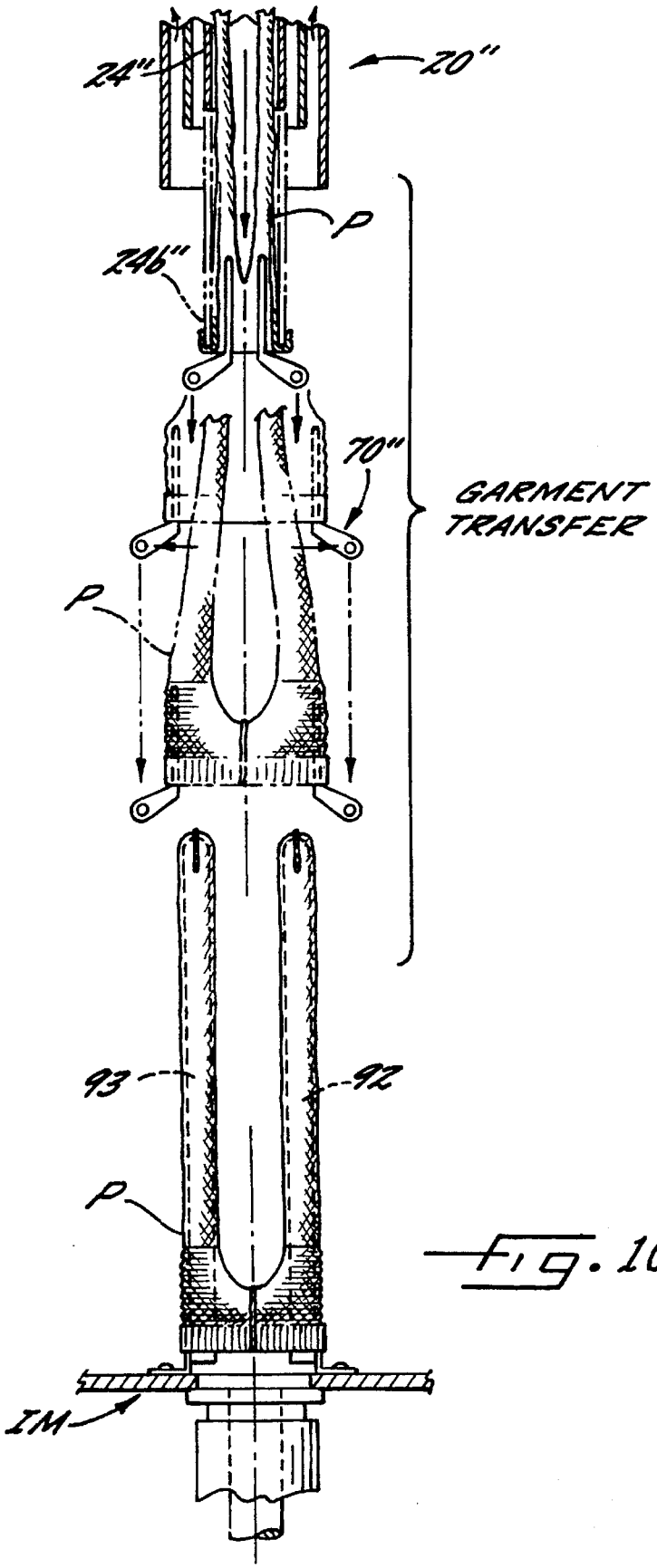
FIG. 10 is a somewhat schematic, fragmentary elevational view, partially in section, of another embodiment of the present invention in which the apparatus of the present invention is associated with an inspection apparatus and illustrating the transfer of a pair of pantyhose from the exit end of a suction tube onto a pair of inspection forms.

Referring now to FIGS. 8, 9 and 10 in which additional embodiments of the present invention are illustrated for delivering pantyhose P for further processing and in which like elements are referred to by the same reference characters with the prime or double prime notations added, the apparatus 20' includes a work station 21' (FIG. 8). Work station 21' includes a table 22' and a console 23'.

Since pantyhose P are being handled, as opposed to pairs of hosiery blanks B, single suction tubes 24', 26' and 28' are provided and have inlet ends 24*a'*, 26*a'* and 28*a'* connected to console 23'. Exit ends 24*b'*, 26*b'* and 28*b'* of suction tubes 24', 26' and 28' are operatively associated with boarding machines $BM_1$, $BM_2$ and $BM_3$, respectively. Boarding machines $BM_1$, $BM_2$ and $BM_3$ may be any conventional boarding machine. However, the boarding machine disclosed in U.S. Pat. No. 4,703,877, issued Nov. 3, 1987, is preferred. The disclosure of U.S. Pat. No. 4,703,877 is incorporated herein by reference.

Opening means 30', 32' and 34' are provided at the exit ends 24*b'*, 26*b'* and 28*b'* of the suction tubes 24', 26' and 28'. These opening means 30', 32' and 34' are of substantially the same construction and operate in substantially the same manner as opening means 30, except larger in size because the panty portion of the pantyhose P is larger than the welt portion W of the hosiery blank B. Therefore, the opening means 30', 32' and 34' will not be further described.

Transfer means 70', 71' and 72' are provided between the exit ends 24*b'*, 26*b'* and 28*b'* of the suction tubes 24', 26' and 28' and the boarding machines $BM_1$, $BM_2$ and $BM_3$. Since boarding forms 90, 91 of boarding machines $BM_1$, $BM_2$ and $BM_3$ are mounted vertically, the exit end portions 24*b'*, 26*b'* and 28*b'* are disposed vertically and the transfer means 70', 71' and 72' reciprocate vertically.

Only transfer means 70' is shown and will be described in any detail since the transfer means 70', 71' and 72' are substantially identical. Transfer means 70' includes respective pairs of gripping fingers 73', 75' (only one finger of each pair being shown). The gripping fingers 73', 75' are mounted on respective shafts 77', 78' for collapsing and spreading movement and for reciprocating movement between the exit ends 24*b'*, 26*b'* and 28*b'* of suction tubes 24', 26' and 28' and the boarding forms 90, 91. In this respect, transfer means 70', 71' and 72' operate in the same manner as transfer means 70, 71 and 72 and will not be further described herein.

In FIG. 10, there is illustrated a further embodiment of the present invention in which apparatus 20" is associated with an inspection machine IM. Apparatus 20" is in all material respects virtually the same as apparatus 20' and therefore only a cursory further description will be made.

A suction tube 24" has an exit end 24*b"* disposed above a transfer means 70" and a pair of inspection forms 92, 93 of an inspection machine IM. Preferably, the inspection machine IM corresponds to that disclosed in U.S. Pat. No. 5,497,235, issued Mar. 5, 1996 and assigned to the assignee of this application, although any conventional inspection machine may be used. The disclosure of U.S. Pat. No. 5,497,235 is incorporated herein by reference.

The method of the present invention and the operation of apparatus 20' and 20" are very similar and will therefore be described together. An operator removes a pantyhose P from a bundle on table 22' and views the console 23' and indicating means (not shown) to locate an available suction tube 24', 26' or 28'. The operator presents the panty portion of the pantyhose to the inlet end 24*a'*, 26*a'* or 28*a'* of an available suction tube which receives the pantyhose P therein by suction and transports the same to the exit end 24*b'*, 26*b'* or 28*b'*.

The panty portion of the pantyhose P is opened by being partially everted and the transfer means 70', 71' or 72' engages, grips and removes the panty portion from the suction tube. The partially everted panty portion is unfolded and the pantyhose is delivered by the transfer means partially onto the boarding forms 90, 91 or the inspection forms 92, 93. Means are provided in the boarding machine and inspection machine to complete the positioning of the pantyhose on the boarding forms or the inspection forms.

In the drawings and the specification, there has been set forth preferred embodiments of the invention and, although specific terms are employed, the terms are used in a generic and descriptive sense only and not for the purpose of limitation, the scope of the invention being set forth in the following claims.

That which is claimed is:

1. A method of delivering elongate flexible objects having two ends and a leading end opening and having different characteristics at opposite end portions thereof in proper orientation for further processing, said method comprising:

providing a bundle of the flexible objects at a work station, removing the flexible objects from the bundle at least one at a time, presenting a selected end of each flexible object removed from the bundle to an entry end of a suction tube, the end selected for presentation ensuring proper orientation of the flexible object for further processing, conveying each flexible object in proper orientation by the suction tube from the work station to a transfer station, preparing the leading, selected end portion of each flexible object for transfer from the suction tube to a flexible object receiving member which is generally elongate on a further processing mechanism, and transferring each flexible object from the suction tube to the flexible object receiving member.

2. A method according to claim 1 wherein the flexible objects are tubular and each flexible object is prepared for transfer by opening the leading end portion thereof.

3. A method according to claim 2 wherein each tubular, flexible object is transferred and the open, leading end portion thereof is placed in surrounding relation to the flexible object receiving member.

4. A method according to claim 2 wherein the leading, selected end portion of each flexible object is opened by being partially everted over the end of the suction tube.

5. A method according to claim 3 wherein each flexible object is transferred from the suction tube to the flexible object receiving member by inserting a pair of transfer members within the open end portion of the flexible object, moving the transfer members away from the end of the suction tube while opening further the end portion of the flexible object, and translating the transfer members along opposite sides of the flexible object receiving member to position the opened end portion of the flexible object in surrounding relation to the receiving member.

6. A method according to claim 3 wherein the suction tubes are arranged in pairs and a pair of flexible objects is presented to each pair of suction tubes for delivery to the transfer station and transfer onto a pair of flexible object receiving members.

7. A method of delivering circular knit hosiery blanks, each having a welt end portion at one end and a toe portion at the other end thereof for processing into pantyhose, said method comprising:

providing a bundle of hosiery blanks at a work station, removing at least one hosiery blank from the bundle, presenting the welt end of each hosiery blank to an entry end of a suction tube, conveying the hosiery blank, welt end first, within the suction tube from the work station to a transfer station, opening the welt end portion of the hosiery blank to prepare the hosiery blank for transfer, and transferring the hosiery blank from the suction tube to one of a plurality of welt receiving members of a line closer.

8. A method according to claim 7 wherein a plurality of suction tubes are arranged in respective pairs and a pair of hosiery blanks are removed from the bundle and the welt ends of the pair of hosiery blanks are presented to the entry ends of a selected pair of suction tubes.

9. A method according to claim 8 wherein the hosiery blanks from a pair of suction tubes are transferred to a selected pair of welt receiving members on the line closer.

10. A method according to claim 9 wherein the pair of hosiery blanks are transferred by inserting two sets of pairs of transfer members into the opened welt portions of the hosiery blanks, moving the pairs of transfer members away from the ends of the suction tubes while opening further the welt portions, and translating the pairs of transfer members along respective welt receiving members of the line closer.

11. A method according to claim 10 wherein the welt portions are opened by being partially everted over the exit ends of the suction tubes.

12. A method of delivering pantyhose in proper orientation for further processing comprising:

providing a bundle of pantyhose at a work station, each pantyhose having a panty portion and two leg portions, removing a pair of pantyhose from the bundle, presenting the panty portion of the pair of pantyhose to an entry end of a selected one of a plurality of suction tubes, conveying the pantyhose, panty portion first, within the suction tube from the work station to a transfer station, opening the panty portion of the pantyhose to prepare the pantyhose for transfer, and transferring the pantyhose from the suction tube onto a pair of forms of a pantyhose processing machine.

13. A method according to claim 12 wherein the pantyhose processing machine is an inspection machine for inspecting the pantyhose for defects.

14. A method according to claim 12 wherein the pantyhose processing machine is a boarding machine for boarding the pantyhose.

15. A method according to either of claims 13 or 14 wherein the panty portion is opened by being partially everted over the end portion of the suction tube.

16. A method according to claim 15 including clamping the leg portions of the pantyhose during opening of the panty portion thereof.

17. A method according to claim 15 wherein the pantyhose is transferred by inserting a pair of transfer members into the opened panty portion, moving the transfer members away from the end of the suction tube while opening further the panty portion, and translating the transfer members along opposite sides of the pair of forms to position the panty portion and partially the leg portions onto the forms.

18. A method according to claim 16 wherein the partially everted panty portion is returned to the uneverted position after insertion of the transfer members to position the panty portion onto the transfer members.

19. Apparatus for delivering elongate flexible objects having different characteristics at opposite end portions thereof in proper orientation for further processing, said apparatus comprising:

a work station including means for supporting a bundle of the flexible objects, a plurality of elongate suction tubes having entry ends disposed at said work station and adapted to receive therein a selected end of a flexible object presented thereto and having exit ends disposed remote from said work station, suction means connected to said suction tubes for creating a suction selectively in said suction tubes to convey flexible objects from the entry ends thereof to the exit ends thereof, and transfer means operatively associated with the exit ends of said suction tubes for removing the flexible objects from the exit ends of the suction tubes and delivering the flexible objects for further processing on generally elongate receiving members.

20. Apparatus according to claim 19 wherein the flexible objects are tubular and including means operatively associated with the exit ends of said suction tubes for opening the selected, leading end portions of the flexible objects.

21. Apparatus according to claim 20 wherein said opening means comprises means for partially everting the selected, leading end portions of the flexible objects over the exit ends of said suction tubes.

22. Apparatus for delivering circular knit hosiery blanks, each having a welt portion at one end and a toe portion at the other end thereof, for processing into pantyhose, said apparatus comprising:

a work station including means for supporting a bundle of hosiery blanks, a plurality of elongate suction tubes having entry ends disposed at said work station adjacent said bundle supporting means for receiving therein the welt portions of hosiery blanks presented thereto and exit ends remote from said work station, suction means connected to said suction tubes for creating selectively a suction in said suction tubes to convey hosiery blanks, welt portions first, from said entry ends to said exit ends thereof, and transfer means operatively associated with said exit ends of said suction tubes for transferring the hosiery blanks, welt portions first, from said exit ends of said suction tubes and delivering the hosiery blanks for processing into pantyhose on generally elongate receiving members.

23. Apparatus according to claim 22 including means operatively associated with said exit ends of said suction tubes for opening the welt portions of the hosiery blanks to prepare the hosiery blanks for transfer.

24. Apparatus according to claim 23 wherein said opening means comprises means for partially everting the welt portions of the hosiery blanks over said exit ends of said suction tubes.

25. Apparatus according to claim 24 wherein said everting means includes an everting tube surrounding said exit end of each of said suction tubes in spaced relation thereto and terminating in a free outer end, said everting tube being mounted for reciprocatory movement axially thereof relative to said exit end of said suction tube from an operative position in which the free end thereof is spaced outwardly of said exit end of said suction tube and a retracted position spaced inwardly of said exit end of said suction tube, closure means for closing the free end of said everting tube when in the operative position and for opening the free end of said everting tube when said everting tube is to be moved to the retracted position, means for reciprocating said everting tube between the operative and retracted positions, and means for connecting said everting tube to said suction means when it is desired to evert partially the welt portions of the hosiery blanks.

26. Apparatus according to claim 22 wherein said suction tubes are arranged in respective pairs and have said entry ends and exit ends adjacent for receiving and conveying respective pairs of hosiery blanks.

27. Apparatus according to claim 26 wherein said transfer means simultaneously transfers a pair of hosiery blanks from said exit ends of a pair of said suction tubes for processing into a pantyhose.

28. Apparatus according to claim 27 wherein said transfer means comprises respective pairs of transfer members mounted for reciprocatory movement relative to said exit ends of said suction tubes between a pick-up position in which said transfer members are within said exit ends of said suction tubes and a delivery position remote from said exit ends of said suction tubes, said transfer members of each pair of transfer members being moveable towards and away from each other for insertion into the welt portions of the hosiery blanks when in collapsed position and for opening the welt portions of the hosiery blanks when in spread-apart position, means operatively connected to said pairs of transfer members for reciprocating said transfer members between the pick-up and delivery positions, and means operatively connected to each pair of transfer members for moving said transfer members between the collapsed and spread-apart positions.

29. Apparatus for delivering pantyhose in proper orientation for further processing, said apparatus comprising:

a work station including means for supporting a bundle of pantyhose, a plurality of elongate suction tubes having entry ends disposed at said work station for receiving panty portions of the pantyhose presented thereto and exit ends remote from said work station, suction means connected to said suction tubes for creating selectively a suction in said suction tubes for conveying the pantyhose, panty portion first, from said entry ends to said exit ends of said suction tubes, respective pairs of forms adapted to receive thereon the pantyhose for further processing, and transfer means operatively associated with the exit ends of said suction tubes for transferring pantyhose from said exit end of said suction tubes and for delivering the pantyhose onto said respective pairs of forms.

30. Apparatus according to claim 29 wherein said forms are inspection forms.

31. Apparatus according to claim 29 wherein said forms are boarding forms.

* * * * *